US005516384A

United States Patent [19]

Mossbeck

[11] Patent Number: 5,516,384

[45] Date of Patent: May 14, 1996

[54] SYSTEM FOR MANUFACTURING FURNITURE AND FURNITURE PARTS OF FIBROUS MATERIAL CARDBOARD

[75] Inventor: Niels Mossbeck, Grandview, Tenn.

[73] Assignee: Ellman Consulting, Fort Lauderdale, Fla.

[21] Appl. No.: 142,002

[22] Filed: Oct. 28, 1993

[51] Int. Cl.[6] ..... B32B 31/00

[52] U.S. Cl. ..... 156/194; 156/156; 156/446; 264/296; 264/314

[58] Field of Search ..... 156/184, 189, 156/191, 193, 194, 195, 392, 156, 446, 457; 242/525.4; 264/296, 314

[56] References Cited

U.S. PATENT DOCUMENTS

| | | | |
|---|---|---|---|
| 2,575,898 | 11/1951 | Tadinger | 156/194 X |
| 2,852,840 | 9/1958 | Harvey | 156/194 X |
| 2,998,339 | 8/1961 | Barnes et al. | 156/194 |
| 3,834,759 | 9/1974 | Panton | 297/445 |
| 4,008,114 | 2/1977 | Lindsey | 156/392 |
| 4,173,313 | 11/1979 | Rogers | 242/525.4 |
| 4,484,716 | 11/1984 | Korcusko et al. | 242/525.4 |
| 4,579,617 | 4/1986 | Oberg et al. | 156/184 |

FOREIGN PATENT DOCUMENTS

| | | |
|---|---|---|
| 696078 | 9/1967 | Belgium . |
| 2017009 | 5/1970 | France . |
| 2307649 | 11/1976 | France . |
| 2343975 | 2/1975 | Germany . |
| 8209206 | 8/1982 | Germany . |
| 9016555 | 5/1992 | Germany . |
| 1356125 | 6/1974 | United Kingdom . |
| 9108885 | 6/1991 | WIPO . |

*Primary Examiner*—James Engel
*Attorney, Agent, or Firm*—Roylance, Abrams, Berdo & Goodman

[57] ABSTRACT

Furniture and furniture parts are formed with support bodies of cardboard laminate. The winding is formed from a cardboard which is pressed into the appropriate shape. If desired, the winding is divided into pieces. Parts of upholstered pieces of furniture, such as armrests, backrests and seat parts can be manufactured.

8 Claims, 5 Drawing Sheets

SYSTEM FOR MANUFACTURING FURNITURE AND FURNITURE PARTS OF FIBROUS MATERIAL CARDBOARD

FIELD OF THE INVENTION

The present invention relates to a method and apparatus for producing pieces of furniture and parts of pieces of furniture from cardboard or cardboard-like fibrous material coated with cold-setting adhesive. Pieces of the coated fiberous material are layered one over the other to form a laminate body formed into a piece of furniture with use of a press and then hardened.

BACKGROUND OF THE INVENTION

Utility Patent DE-UI-82 09 206 discloses producing stools, backrests or curved seat shape parts stamped out of pasteboard or cardboard coated with cold-setting adhesives. The pasteboard or cardboard pieces are laid out in a press and are pressed to form seat shells or backrest shells. As soon as the cold-setting adhesive has hardened, the laminate is removed from the press mold.

This method is disadvantageous since only moderately curved parts can be produced, and since a relative long time is required for the cold-setting adhesive to harden. Thus, the press and mold is overlaid for a long time. Also, scraps from stamping collect in great quantities.

SUMMARY OF THE INVENTION

An object of the present invention is to provide a method and apparatus in which pieces of furniture and furniture parts, even with acute curves, can be produced in short mold times.

Another object of the present invention is to provide a method and apparatus in which furniture and furniture parts can be produced simply, reliably and relatively inexpensively.

The foregoing objects are obtained by a method of manufacturing furniture and furniture parts of fiberous material cardboard, comprising coating, winding, pressing, removal and final hardening steps. In the coating step, a cardboard strip is coated with cold setting adhesive. In the winding step, the coated cardboard strip is wound into a hollow winding about a core and a winding axis with portions of the cardboard strip overlying one another to form a laminate body. In the pressing step, the hollow winding is pressed into a furniture part between movable inside rigid mold bodies and movable outside rigid mold bodies. In the removal step, the pressed hollow winding is removed from the mold bodies and the core. In the final hardening step, the pressed hollow winding is hardened.

The method of the present invention is based on formation of a winding of the cardboard or fibrous material to be laminated. The not yet bonded cold-setting adhesive allows the winding to be shaped definitively with inside and outside press tools into one final blank form in which the laminate layers are solidified and compacted. The pressing before bonding heightens the adhesion of the cold-setting adhesive. The blank is so sturdy, as a result of its shape, that it can be removed immediately from the press. Final hardening of the cold-setting adhesive occurs in an intermediate bearing or storage facility. Any further processing, such as the introduction of supports and the attaching of final catch fastening fixtures with glue is possible even before the blank has hardened, so that no additional separate hardening times are required.

With the profiling and pressing procedures, screw holes, clearances and the like can be introduced into the material by means of pneumatically or hydraulically controlled stamps. Thus, the stamps and the insert mechanisms need not be associated directly with the cheeks or mold surfaces of the press.

If allowed by prevailing conditions, the blanks can be divided or broken down with sawtooth cuts. Additionally, a lath-like seat or backrest surface support structure can be constructed.

Connections of the seat or catch fastening structures, as well as connections between several laminate parts, can be produced by clamp connections cast directly in the laminate in the desired alignment. Forming the connections in this manner provides an excellent hold.

The laminate is preferably formed of a coarse, packing paper-like recycled cardboard, produced of old paper and/or ground up old paper. New pasteboard or new paper can also be used. The cold-setting or warm-setting adhesive or some other adhesive can be used as connecting means. Cold-setting adhesive can be a pollutant-free bookbinding glue, e.g. PVA. Any material including polyvinyl alcohol is very suitable as cold-setting adhesive. Two to 25 winding layers of a cardboard of 25 to 1200 g/square meter suffice to form a support plate or wall structure of a recliner or seat.

The foregoing objects are also obtained by an apparatus for manufacturing furniture and furniture parts of fiberous material cardboard, comprising a supply roll of fiberous material cardboard having a supply roll drive. Guide rollers define the supply path. An adhesive application roll is arranged between two guide rollers. A winder with a winding core drive and a detachable first winding core is adjacent the adhesive application roll. The winding core includes core members slidable relative to one another within limits. A press is located adjacent the winder, and has movable inside rigid mold bodies and movable outside rigid mold bodies.

The devices for execution of winding and pressing procedures are advantageously several meters wide. With each winding procedure at least one recliner unit, several armrest parts, mattress foundations or other furniture supports parts can be produced. The winding core advantageously includes an expandable base, on which are placed individual crowns of material shaped generally in accordance with the model to be completed. The core of the winding can be held interchangeably in a stand which includes the winding drive. Two winding cores can be used alternately, each one pressed in the press and then removed from the press and mold while the other is being wound. Alternatively, the winding can be removed from the winding core and be forced onto a separate press core. The winding device can be operated almost without interruption.

The cardboard strip moves from the supply roll over a supply path to the adhesive application roll and then to the winder. To prevent the adhesive from soaking through the strip during an exchange of the winding cores or when the winder is stationary for some time for any other reason, a device can be provided to remove the strip from contact with the adhesive roller. The strip can also be held securely with holding cleats before and behind the adhesive application while the winding core is being changed.

If needed, perforation devices can be distributed over the width of the strip when a plurality of objects are produced parallel to one another, for example, as armrest parts. A transverse blade on a roller can separate the strip off in pieces following each predetermined number of windings.

The winding core can be brought into the press by a lifting and transverse transport carriage. The core can then be coupled to a compressed air conduit, to expand the core until it reaches its final shape during the final action inside the mold. Press dies or stamps press the winding simultaneously from several sides. The stamps can be furnished with suitably shaped mold parts. After a few seconds, the pressing procedure is terminated, the mold dies or stamps are pulled back and the winding core is contracted. The winding core can then be withdrawn and placed in some intermediate bearing or storage arrangement until the next winding is inserted in the mold, and the winding core inserted and fitted into the winding device again.

Cams can be provided on the winding core to signal certain rotary angles, so that the introduction of the beginning of the strip, the position of the cut-off strip end, and the opening of the temporary storage facility to receive the winding all occur at predetermined angle positions. The delayed start of the adhesive application can be controlled by a timing device which can be adjusted at a control panel. Stopping of the glue application can be controlled by an adjustable pulse device. Preferably, no adhesive is applied in the separation cut area, so that the mold parts do not adhere to each other or to the strip. The beginning of the strip in each case can be held securely with a clamp or gripping bar fitting on the winding core, which is controlled hydraulically with a sensor.

For the production of convex-shaped windings, suitably shaped winding core equipment can be provided as necessary with the inside mold parts and the outside mold parts being designed to complement this arrangement. Substructures for armrests of upholstered furniture, backrest support structures, and seat and recliner support parts of simple structure can be manufactured with such an arrangement of the equipment. Ornamental and design features and pieces, e.g., in the handrest area on the foam material armrests, can be placed on these support parts.

For instance, two backrest shells can be formed at the same time out of a longitudinally divided winding of suitable shape, and then be inserted in the upholstery material. Likewise, two U-shaped angled elements can be forced out of somewhat rectangular angled element, which serve in turn as a seat.

The comfort of the seat can be increased when the seat surface is perforated or slotted lattice-like. The perforation is executed advantageously while in the not yet hardened state, so that a reinforcing bead edge is formed.

The entire clamped-together base frame made up of the individual parts being clamped together is advantageously covered with a conventional upholstery covering. Thus, an attractive, comfortable and stable piece of upholstered furniture is manufactured with relatively low labor cost, from environmentally friendly material which for the most part has already been recycled and can be completely recycled once again.

One further advantageous configuration of the basic parts of a piece of furniture is attained by the winding core of a special press core having one or more recesses. The press is shaped complementarily in the area of the cheeks or mold parts of the press to form the recesses. Each winding core recess is furnished with a support structure which can be adjusted and can be withdrawn in a controlled manner, over which the winding is constructed.

This winding support structure can be an inflatable hose which is evacuated or omitted during the pressing procedure, or expanded by hydraulic cylinders. The support is then set up so that the portion of the winding spread thereover fits into the recess when the press presses it. Concave shapes are formed in this manner, e.g., the inside backrest seat part of an upholstered chair. The construction of this structure in one piece deletes the connection work, saves on reinforcement material and therewith also saves on weight.

When the winding is removed from the winding core directly following its completion and is then placed in a suitably constructed press core, it then can be pressed into complex, concave and convex shapes, formed out of the still-deformable winding. If the press core is constructed shorter than the winding core, then beveled edges on the front side of the winding as well as gussets in the corner areas can also be worked in. This yields very rigid shell shapes.

Further, decorative shapes can be produced, for instance in the backrest designs. Narrow, blunt press stamps can press folds into narrow slot-like notches. As a result, side notches in the backrest top edge can likewise be produced as deformations folded in the third dimension which project out over the limited, defined press deformation.

The new technology of the invention can employ a high-density fiber laminate (HDF).

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
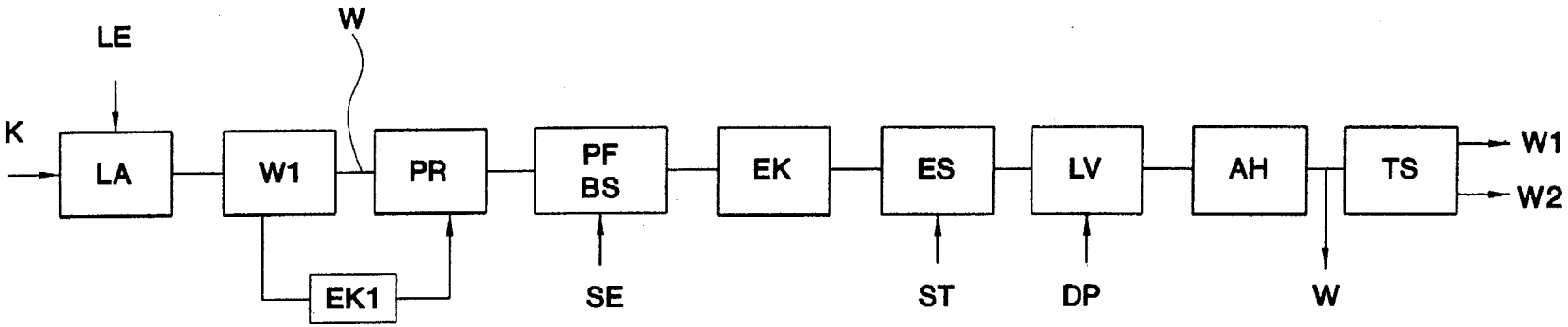
FIG. 1 is a diagrammatic, block diagram of the lamination system according to the present invention.

FIG. 1 is a diagram of the method for production of the furniture structural parts according to the present invention. This method includes the basic steps of adhesive application LA of the adhesive LE to the cardboard K, the winding WI of the coated cardboard to form hollow windings, the pressing PR of the winding W in presses, the removal of the windings from the core EK, as well as the removal from the mold and in turn the hardening AH. For this purpose, a perforation PF and/or an equipping BS of the winding W with anchors, dowels, screw holes SE or the like can be supplied during pressing PR. Furthermore, incorporation of an insert ES and traverses or rails secured with clamps ST as well as an adhesive or glue LV and inclusion of cover plates DP on the front of the openings of winding W can occur even before hardening AH.

Winding W is preferably sectioned, as desired, into several parts W1, W2 after hardening AH, in a separating stage TS parallel to the winding axis. Here too, incorporation of sawtooth cuts and so forth can occur. Winding W can alternatively be withdrawn into a first stage EK1 for removal from the core and be thrust on a separate press core.

The production steps are controlled by a microprocessor with a predetermined program. This program, as well as the construction and organization of the system, permits operation by a single operator.

Figure 2:
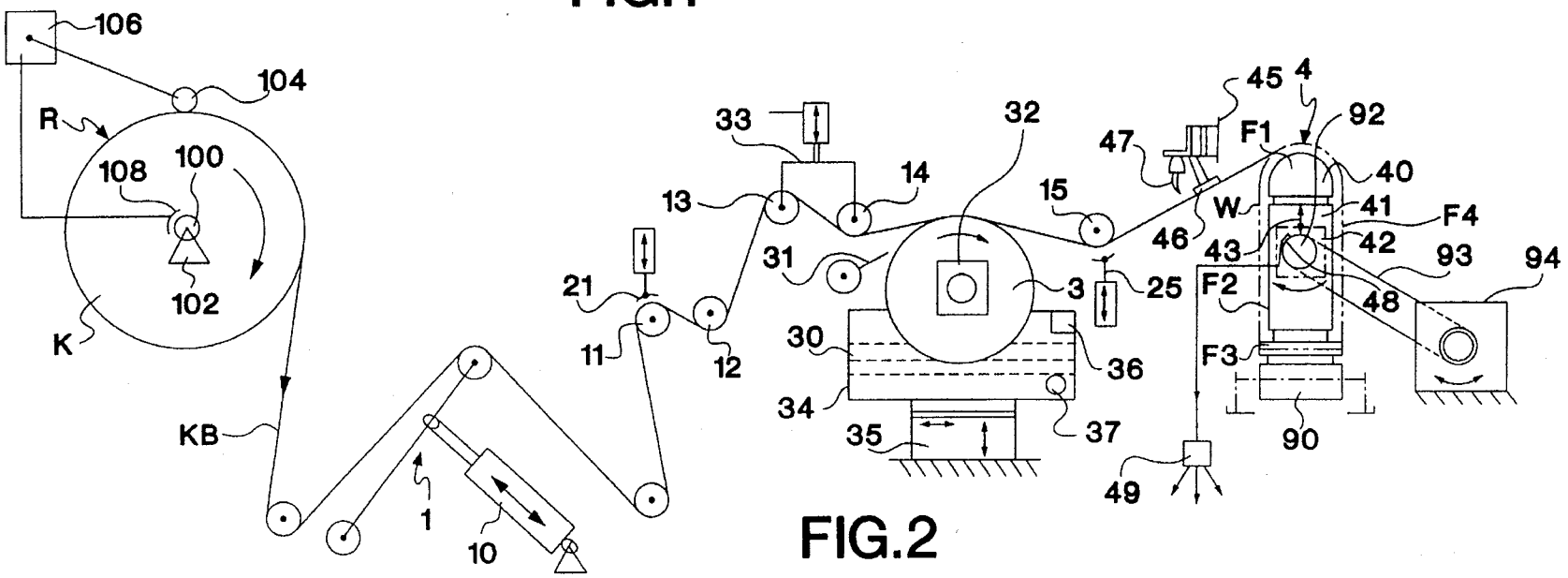
FIG. 2 is a side elevational view diagrammatically illustrating a winding device according to a first embodiment of the present invention.

FIG. 2 shows a diagram of a winding device. The cardboard K is unwound from a supply roll R as cardboard strip KB, and is conducted over a strip tensioner 1. The cardboard can be made from recycled paper or pasteboard material, having a surface weight of 50 to 350 grams per square member. Tensioner 1 continually places a biasing stress on cardboard strip KB by means of a compressed air or pneumatic cylinder 10, and forms a supply path for the material of supply roll R. In addition, the winder 4 is mounted on pivot arms 93 coupled to a pivot drive mechanism 94 providing lengthwise compensation.

Supply roll R is mounted for rotation on an axle 100 which is rotatably mounted in a support 102. A pivotally mounted paper gauge 104 engages the outer surface of the paper roll to monitor the paper roll diameter. A brake control 106 is coupled to paper gauge 104 and regulates the pressure applied by the pneumatically operated, disc-type brakes 108 to axle 100. With a smaller paper roll, less brake pressure is applied. With a larger paper roll, greater brake pressure is applied.

The cardboard strip KB is guided by a plurality of guide rollers or pulleys 11 to 15. The first and last guide pulleys cooperate with controllable retaining cleats 21 and 25, which hold the cardboard strip KB securely when winding core 4 is not being rotated. Between guide pulleys 14 and 15, an adhesive application roll 3 is arranged. Roll 3 dips its bottom side in an adhesive bath 30 and, after leaving the bath, rotates past a doctor blade 31, and then applies adhesive to the top of the cardboard strip KB. The direction of rotation and the velocity of adhesive application roll 3 correspond approximately to that of cardboard strip KB. For adjusting the rotation of roll 3, an adjustable roll drive 32 is attached to roll 3 through a setting gear, which obtains its set-point signal from down stream guide roller 14. Alternatively, a slower gearing can be provided with a freewheel which assures moving along with the strip.

Both of the guide rollers or pulleys 13 and 14 located immediately upstream from adhesive application roll 3 are connected with a lifting device 33. Device 33 lifts cardboard strip KB from adhesive application roll 3 when cardboard strip KB is stationary or no glue is to be applied. The roll drive 32 continues to rotate roll 3 with the original rotary speed to prevent drying of the adhesive on the exposed outside surface.

A timer, adjustable from a control panel, controls the application of glue on the paper strip, by controlling the operation of lifting device 33. The glue application is delayed such that glue is not applied to the paper directly contacting the mold or core to avoid sticking of the paper to the mold or core. The glue operation is halted by the lifting device controlled by an impulse device which can be adjusted to a preset number of impulses generated for each winding core turn.

The adhesive bath 30 is controlled continuously by a gauge measure 36 and a viscosity meter 37. Gauge measure 36 retains the fill level state by regulating filling to a predetermined level. The viscosity is constantly tested and is stabilized by addition of the necessary liquid. The adhesive bath container 34 is arranged on a device 35 for movement vertically and horizontally. The vertical movement permits the device to be lowered for cleaning, and then raised to an operational position. The horizontal movement, generally in the direction of paper movement permits adjustment of the glue application.

The glue application device is followed by the winding core 4 with the winding core drive mechanism 42. Winding core 4 includes two core members 40 and 41 slidably coupled within limits relative to one another. The members 40 and 41 can be provided with exchangeable mold parts F1 and F4. The outside surfaces for the mold parts determine the inside configuration of the winding W. The two core members 40 and 41 are pressed away from one another by three pneumatically or hydraulically operated cylinders 43 (preferably hydraulic) and are pulled together by springs. The cylinders expand the core for the winding operation by a foot actuated electrical switch. After the desired number of paper windings are formed on the core, the controlling computer generates a signal to collapse the hydraulic cylinders and the winding core or mold.

Figure 2A:
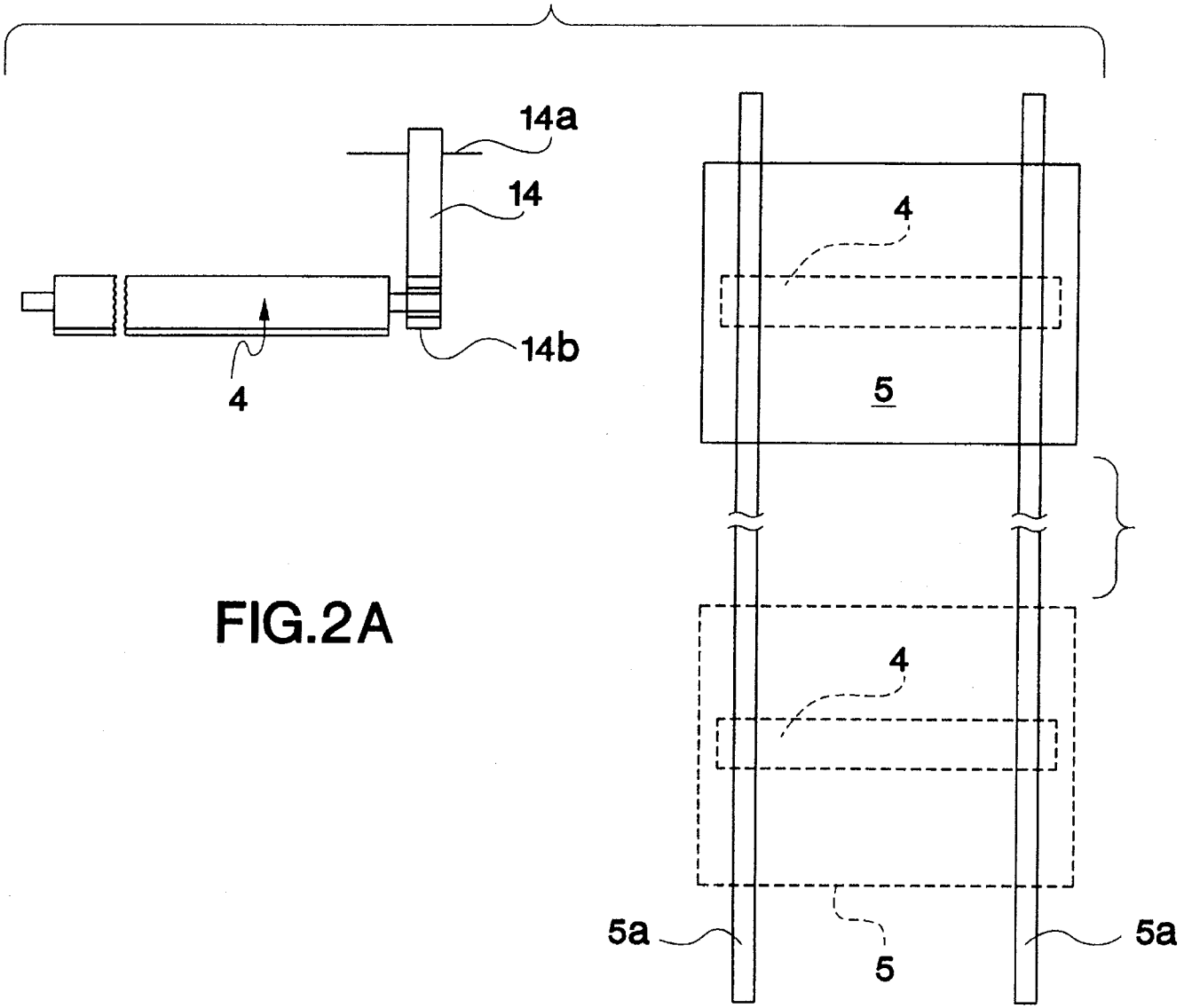
FIG. 2A is a top plan view diagrammatically illustrating the relationship of the winding device and the press according to the present invention.

The two axial bearings 44 (FIG. 4) on one end of winding core 4 are separated and are pneumatically controlled to open, so that winding W with the winding core can be removed and conveyed to the press. Winding core drive 42 is located between a double bearing 44 which facilitates universal support of winding core 4 with winding W, so that following the swiveling away of one bearing arm 14 about axis **14*a* relative to the winding core end 92 adjacent bearing arm 14, winding W can be removed from the winding core (FIG. 2A). The bearing arm has a U-shaped end 14*b* which receives and supports one end of the winding core in the arm operative position during winding. A winding termination and removal device 90 can facilitate removal of winding W from winding core 4. Winding core bearings 91 and 92 can pivot around a common axis 95, so that the pivot drive 94 operates on the cardboard strip KB at constant winding velocity and exerts a constant pull with identical forward thrust. Typically, the winding is formed with 10 to 16** cardboard layers.

In front or upstream of winding core 4, a transverse cutter 45 is arranged. The cardboard strip KB is held from above with suction cups 46 adjacent the movement path of cutter 45, while a completed winding W is removed and until a fresh winding core 4 is inserted. Controllable notching knives 47 are mounted on the cutting supports which are slidable along the side and securable. Knives 47 longitudinally notch the cardboard strip KB when a plurality of parts are produced parallel to one another. Transverse cutter 45, retaining cleats 21, 25, suction cups 46 and lifting device 33 are controlled by adjustable control cams 42 on the winding core axis in combination with a winding counter 49.

Figure 3:
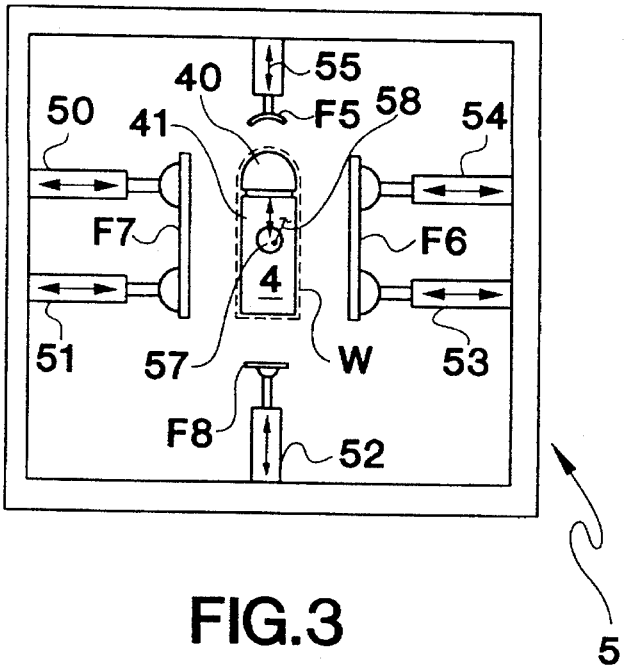
FIG. 3 is a side elevational view diagrammatically illustrating a press according to a first embodiment the present invention.

FIG. 3 is a diagram of a press 5 with the hydraulic or compressed air compression cylinders 50 to 56 arranged in a frame surrounding all sides of pressing or winding core 4. Core 4 carries winding W to be inserted in a central bearing arrangement 57. The compressed air stamps support outside rigid mold parts or bodies F5 to F8, which are configured complementary to the rigid inside mold parts or bodies F1 to F4 of the core. A hydraulic pressure connection 58 is located on central bearing arrangement 57, where the hydraulic pressure cylinders expand core members 40 and 41 against winding W and the outside mold parts, and releases the tension following withdrawal of the outside mold parts of the press,so that winding W can be removed. The hydraulic pressure stabilizes the system permitting formation of both concave and convex shapes.

As illustrated in FIG. 2A, press 5 can move as a unit translationally along tracks 5*a* between two positions. In the first position illustrated in solid lines, the cores 4 of the winding device and of the press are axially aligned to permit a single operator to move the winding from the winding device after winding to the press for pressing, easily and quickly. As the winding is being pressed in press 5 and another winding operation is initiated, the press moves to the second position illustrated in phantom lines, where the press is adequately spaced from the winding device to facilitate removal of the pressed winding from press 5 without interference with the winding device and is adjacent the storage area for placing the pressed winding on a wooden pallet for drying.

Figure 4:
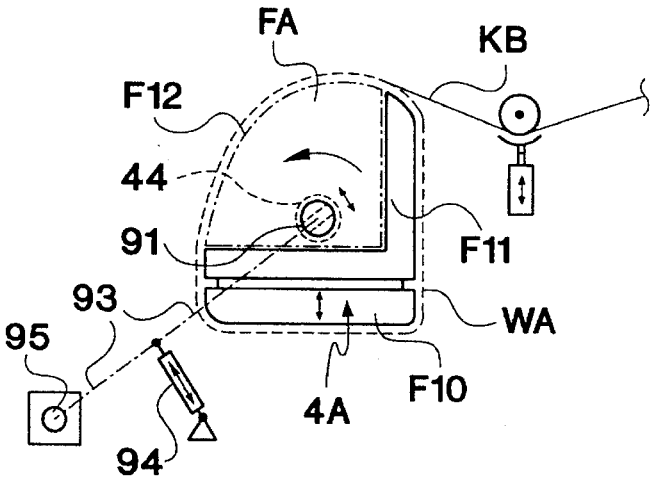
FIG. 4 is a slide elevation view of a winding core with winding according to a second embodiment of the present invention.

FIG. 4 shows another winding core embodiment 4A. Winding core 4A includes a cut-out FA next to expanding mold parts F10 and F11. Mold parts F10 and F11 are supported by side flanges. An expandable support body F12 is arranged between the side flanges. The entire periphery side of winding W includes mold parts F10 and F11 and support body F12, and corresponds to the periphery of the completed lamina part.

Figure 5:
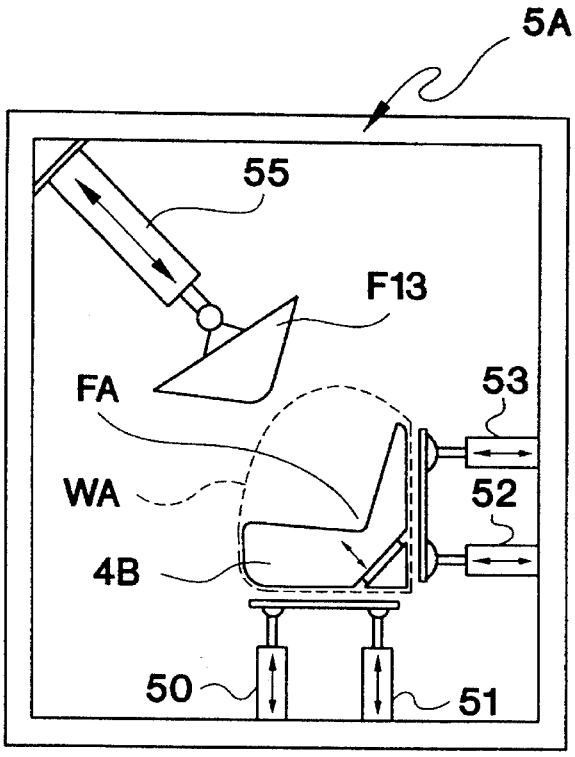
FIG. 5 is a side elevation view of the presses of FIG. 4.

FIG. 5 shows a press embodiment 5A with an inserted press core 4B and the winding WA. The hydraulic or pneumatic stamps 50 to 55 are arranged on two sides and facing in the direction of cut-out FA. A mold part F13 is mounted on pressure stamp 55 in an articulated manner, and fits into cut-out FA to press winding WA in and to deform it concavely.

Figure 6:
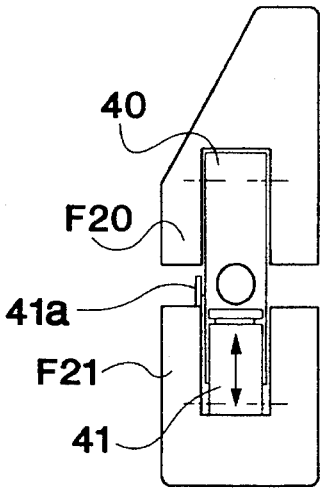
FIGS. 6 and 7 are side elevational views of winding cores according to third and fourth embodiments of the present invention.

FIG. 6 shows another winding core arrangement with one rectangular mold member F21 and one trapezoidal mold member F20 mounted on core member 41. An armrest can be formed with this arrangement. Preferably, as graphically illustrated in FIG. 6, winding core 40 and 41 includes a gripping bar 41*a*. The gripping bar defines a slot for receiving and gripping an end of the paper roll to secure the paper to the winding core at the start of the winding process. The end of the paper is locked and released in the slot by the hydraulic power mechanism of the winding core which expands and contracts the winding core for the winding operation and for removal of the paper winding from the core, respectively.

Figure 7:
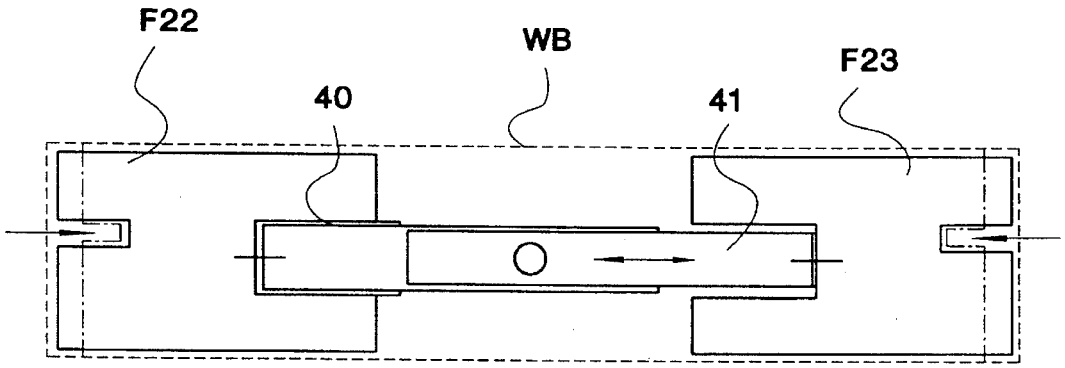

FIG. 7 shows a press core arrangement with two long rectangular mold pieces F22 and F23. A bed box with a reclining box can be formed with this arrangement. Longitudinal, as well as transverse sides, can be pressed into shape. The completed pressed winding WB is gripped along the narrow sides and then is removed from the mold. A high degree of adjustability of the core parts permits profiling of the narrow sides with a different mold part from that used in longitudinal direction, which can then be removed from the mold by drawing core pieces 40 and 41 together.

Figure 8:
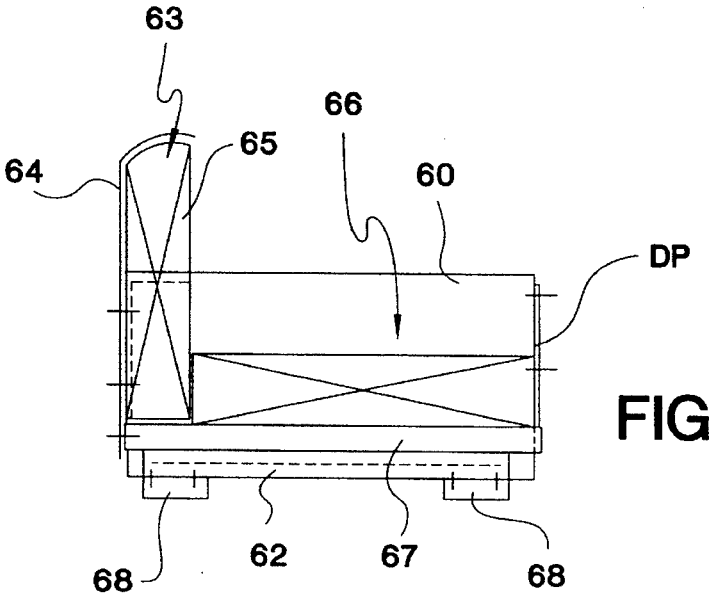
FIG. 8 is a side elevational view in section of an upholstered seat formed according to one embodiment of the present invention.

FIG. 8 shows an upholstered seat in vertical section through mid-plane. Armrest 60 is formed of a wound profile, as shown in FIGS. 2 and 3. A catch fastening plate DP is adhered and clamped to the front of the seat. Support strips 62 are clamped onto the bottom of the seat surface. Backrest 63 is formed of a smooth angle profile with rounded narrow sides, separated symmetrically axially at the point of the rounding, so that the one half forms the backrest support 64 on which the inside area is mounted a foam upholstery or pad 65. The seat 66 is formed of a narrow-sided separated flat wound part 67 with an upholstery covering 66. The entire piece of furniture is covered with an appropriate upholstery not shown. Under the armrest side parts 60 and found feet 68.

Figure 9:
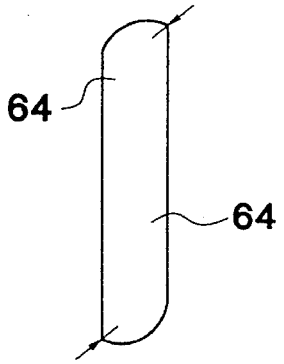
FIG. 9 is a side elevational view of a rough blank of two backrest supports before being separated.

The blank winding of the backrest support 64 before separation is shown in FIG. 9.

Figure 10:
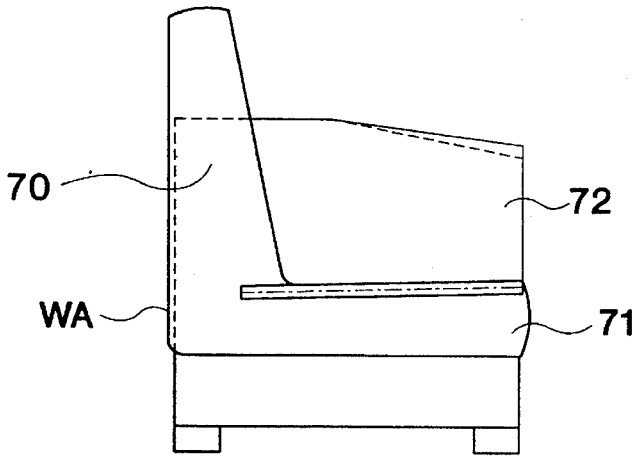
FIG. 10 is a side elevational view in section of an upholstered seat according to another embodiment of the present invention.

FIG. 10 shows an upholstered piece of furniture of a second type without its covering over the central section. The concave winding WA forms the backrest 70 and seat 71. The armrest 72 is formed of a tunnel-shaped winding. This is sealed at the front.

Figure 11:
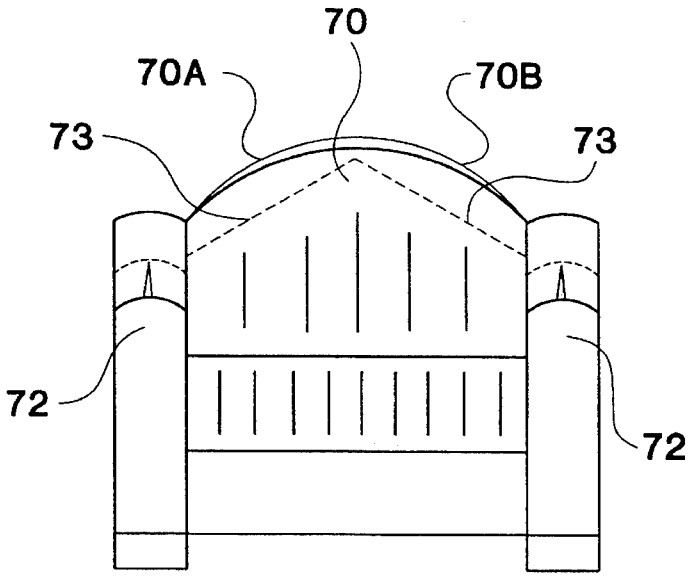
FIG. 11 is a front elevational view of an upholstered seat, without covering, obliquely from above.

FIG. 11 shows an upholstered piece of furniture of a second type without any covering obliquely from above the front. Backrest 70 is lowered in the shoulder areas 70A and 70B, and folds 73 are pressed in the shoulder areas from above. The seat 71 can be sawed out to form an aperture, a slit or a lattice-like separation on the top side of the winding.

Figure 12:
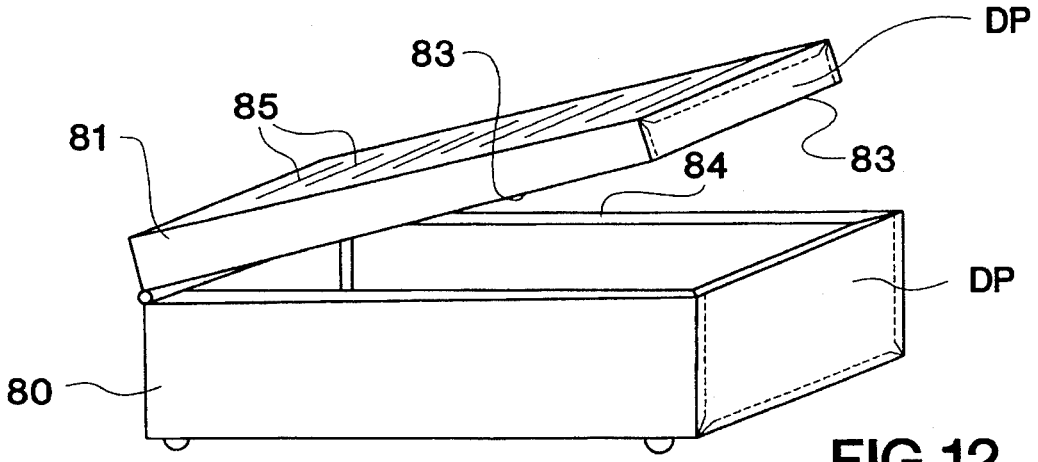
FIG. 12 is a perspective view of the basic body of a recliner according to the present invention.

FIG. 12 shows the basic body of a piece of furniture which will be a recliner and which is produced on the winding core illustrated in FIG. 7. The longitudinal sides of the winding are separated. The one segment 80 serves as a bed box. The second segment 81 is the U-shaped reclining support which receives the upholstery. Beneath the inside edge of bed box 80 is beveled surrounding reinforcement and supporting collet 84. Reclining member 81 is supported on collar 83 which rests on collet 84. On one side, reclining member 81 is articulated with or hinged to bed box 80. The front of the U-shaped profile parts are adhered to cover plates DP. The shape of the box features, with low weight, a high support capacity and good bending resistance of the laminate. Additionally, corrugations, folds and/or notches 85 can be pressed in a transverse direction into the recliner support surface or to cut them in to produce any required elasticity of the profile.

Also, shelf or partition parts, table parts, table frames and so forth can be produced with suitable selection of the transverse cuts through the winding. Instead of an upholstery covering, a traditional surface covering or a temporary covering including a decorative foil or a veneer can be provided at the end of the winding procedure. For this purpose, special support systems pre-coated with adhesive agent are suitable.

While various embodiments have been chosen to illustrate the invention, it will be understood by those skilled in the art that various changes and modifications can be made therein without departing from the scope of the invention as defined in the appended claims.

What is claimed is:

1. A method of manufacturing furniture and furniture parts of fiberous material cardboard, comprising the steps of:

in a coating step, coating a cardboard strip with cold setting adhesive;

in a winding step, winding the coated cardboard strip into a hollow winding about a core and a winding axis with portions of the cardboard strip overlying one another to form a laminate body with a hollow interior;

in a pressing step, pressing the hollow winding into a furniture part between movable inside rigid mold bodies positioned inside the hollow winding and movable rigid outside mold bodies positioned outside the hollow winding to form a pressed hollow winding;

in a removal step, removing the pressed hollow winding from the mold bodies and the core; and in a final hardening step, hardening the pressed hollow winding.

2. A method according to claim 1 wherein, in said winding step, the cardboard strip is releasably secured to the core with a gripping bar.

3. A method according to claim 1 wherein, in said winding step, the cardboard strip is supplied from a rotating roll; and a braking force is applied to the roll as the cardboard strip is fed therefrom, the braking force decreasing as the roll is reduced in size.

4. A method according to claim 1 wherein, in said pressing step, the mold bodies simultaneously move translationally between a first position axially aligned with the core and a second position laterally spaced and parallel to the core.

5. A method according to claim 1 wherein, in the winding step, the coated cardboard strip is wound in a radially convex shape; and, in the pressing step, the concave shape of the hollow winding is pressed into a concave shape.

6. A method according to claim 1 wherein, before said final hardening step, glue is applied and cover plates are attached to hollow winding axial end openings.

7. A method according to claim 1 wherein, in a separating step, the hollow winding is divided into a plurality of parts in planes parallel to the winding axis.

8. A method according to claim 7 wherein, in said separating step, clearance forming notches are incorporated into the hollow winding.

* * * * *